US011613392B2

(12) United States Patent
Hirt

(10) Patent No.: US 11,613,392 B2
(45) Date of Patent: Mar. 28, 2023

(54) APPLICATION DEVICE FOR APPLYING ADDITIONAL ELEMENTS TO PACKAGES

(71) Applicant: SIG Technology AG, Neuhausen am Rheinfall (CH)

(72) Inventor: Daniel Hirt, Klettgau (DE)

(73) Assignee: SIG Technology AG, Neuhausen am Rheinfall (DE)

( * ) Notice: Subject to any disclaimer, the term of this patent is extended or adjusted under 35 U.S.C. 154(b) by 283 days.

(21) Appl. No.: 16/607,395

(22) PCT Filed: Apr. 23, 2018

(86) PCT No.: PCT/EP2018/060329

§ 371 (c)(1),
(2) Date: Oct. 23, 2019

(87) PCT Pub. No.: WO2018/197405

PCT Pub. Date: Nov. 1, 2018

(65) Prior Publication Data

US 2020/0047936 A1 Feb. 13, 2020

(30) Foreign Application Priority Data

Apr. 27, 2017 (DE) ..... 10 2017 109 120.3

(51) Int. Cl.
*B65B 61/20* (2006.01)

(52) U.S. Cl.
CPC ..... *B65B 61/205* (2013.01); *B65B 61/202* (2013.01)

(58) Field of Classification Search
CPC .... B65B 61/202; B65B 61/205; B65B 35/243
See application file for complete search history.

(56) References Cited

U.S. PATENT DOCUMENTS 4,293,369 A * 10/1981 Dilot ..... B65B 61/205 156/521
4,351,679 A * 9/1982 Dreher ..... B65B 61/202 156/70

(Continued)

FOREIGN PATENT DOCUMENTS

CN 101941541 A 1/2011
DE 2902899 A1 8/1979

(Continued)

*Primary Examiner* — Andrew M Tecco
(74) *Attorney, Agent, or Firm* — The Webb Law Firm

(57) ABSTRACT

Described and depicted is an application device for applying additional elements, in particular straws, to packages, preferably cardboard composite packages, having at least one transport device for transporting the packages along a transport track having at least one applicator adjustable, from a pick-up position for picking up the additional elements, to an application position for applying the additional elements to the packages and back. To facilitate the application of the additional elements at a higher application speed without having to take on considerable losses with regard to the reliability of the application of the additional elements or the complexity of the equipment, it is provided that at least one positioning belt extending at least in sections along the transport track of the packages is provided such that the additional elements applied to the packages are held on the packages, in particular pressed onto the packages along at least a part of the transport track by the positioning belt.

20 Claims, 7 Drawing Sheets

(56) References Cited

U.S. PATENT DOCUMENTS

| | | | | | |
|---|---|---|---|---|---|
| 4,372,797 | A * | 2/1983 | Dilot | B65B 61/205 | 156/249 |
| 4,584,819 | A * | 4/1986 | Hakansson | B65B 61/205 | 53/410 |
| 4,589,947 | A * | 5/1986 | Tsuda | B65B 61/205 | 156/521 |
| 4,969,308 | A * | 11/1990 | Hakansson | B65B 61/205 | 53/133.1 |
| 6,105,340 | A * | 8/2000 | Draghetti | B65B 61/202 | 53/415 |
| 6,282,865 | B1 * | 9/2001 | Bergstrom | B65B 61/205 | 53/128.1 |
| 8,387,967 | B2 * | 3/2013 | Bischoff | B65B 19/22 | 271/3.06 |
| 8,647,459 | B2 * | 2/2014 | Spatafora | B65H 29/008 | 156/204 |
| 10,913,563 | B2 * | 2/2021 | Zarur | B65B 57/08 | |
| 2011/0002754 | A1 * | 1/2011 | Spatafora | B65H 45/16 | 412/1 |
| 2011/0062658 | A1 | 3/2011 | Bischoff et al. | | |

FOREIGN PATENT DOCUMENTS

| | | | |
|---|---|---|---|
| DE | 3824013 | C2 | 2/1997 |
| DE | 102006001800 | A1 | 7/2007 |
| DE | 102009040918 | A1 | 3/2011 |
| EP | 0952085 | A1 | 10/1999 |
| EP | 1042172 | B1 | 4/2004 |
| GB | 1492526 | | 11/1977 |
| JP | S61152537 | A | 7/1986 |
| JP | H0257534 | A | 2/1990 |

* cited by examiner

APPLICATION DEVICE FOR APPLYING ADDITIONAL ELEMENTS TO PACKAGES

CROSS-REFERENCE TO RELATED APPLICATIONS

This application is the United States national phase of International Application No. PCT/EP2018/060329 filed Apr. 23, 2018, and claims priority to German Patent Application No. 10 2017 109 120.3 filed Apr. 27, 2017, the disclosures of which are hereby incorporated by reference in their entirety.

BACKGROUND OF THE INVENTION

Field of the Invention

The invention relates to an application device for applying additional elements, in particular straws, to packages, preferably cardboard composite packages, having at least one transport device for transporting the packages along a transport track having at least one applicator adjustable, from a pick-up position for picking up the additional elements, to an application position for applying the additional elements to the packages and back. The invention further relates to a method for applying additional elements, in particular straws, to packages, preferably cardboard composite packages, using such an application device.

Description of Related Art

Packages are formed by packaging and the packaged good received therein. For example, bottles, tubular bags, cans, etc. may be possible packaging. The present packages are primarily composite packages, which are used as alternatives to bottles or cans. Corresponding packaging is mainly filled with the packaged good and sealed in a so-called filling machine, which for cardboard composite packages are often also referred to as forming/filling/sealing machines based on their main functions, specifically forming the packaging, filling the packaging and sealing the packaging.

Possible packaged goods are in particular flowable, i.e. liquid or at least pasty and, as required, can also contain lumpy parts. Dry and granulated packaged goods are not excluded, but do not play a significant role in practice. Often, foodstuffs are received in the packages, such as drinks, in particular milk, juices, nectars, dairy products and soups. In the case of drinks, cardboard composite packages are also referred to as drinks carton composite packages.

Composite packages are formed from interconnected packaging materials which form a sheet-like layer structure, the so-called packaging laminate. Cardboard composite packages have a cardboard layer, which gives the package stability and can serve as a carrier layer for the plastic layers arranged on both sides of the cardboard layer. Plastic layers serve as liquid barriers, for example. Thus, for example, the penetration of flowable products into the packaging laminate, in particular the cardboard layer, or even the leakage of flowable products is also avoided, as is the penetration of moisture from the outside. Furthermore, thermoplastic materials can be sealed to form firmly bonded sealing seams so as to form a packaging and seal the package. The packaging laminate may comprise further layers and packaging materials, for example an aluminium layer provides a barrier effect against gases and light. To be able to fold the sheet-like packaging laminate, i.e. to be able to fold it by machine, creases are often introduced into the packaging laminate which predefine the later fold lines. The folds form the package edges on the package and/or facilitate the shaping of the bottom and/or top of the package. Most packaging laminates are also printed with a decor.

The packaging laminate can be cut before forming the packaging, whereby so-called blanks are created. These may be further processed into so-called packaging casing blanks. For this purpose, the longitudinal edges are overlapped and sealed together to form a longitudinal sealing seam. A pipe-like casing or a so-called packaging casing blank or packaging sleeve is obtained in this way. Alternatively, the packaging laminate can be provided as continuous material, in particular as rolled goods, from which a packaging can be directly formed without first creating a blank.

Packages, such as those for foodstuffs, which can be designed as cardboard composite packages, are partially provided with additional components on the outer side, which for example can be designed as straws, which are also referred to as drinking straws, resealable spouts and/or opening elements, tear-off tabs, which are also referred to as pull tabs, labels or similar. For this purpose, special application devices are used which guide the packages with a transport device along a predetermined transport track along the application device. The packages can thus be guided past the application device or through the application device, for example. Furthermore, an applicator is provided which picks up the additional elements at a pick-up position and delivers or applies them successively to packages moved along the transport track at an application position. Thus, the additional components are pressed into an adhesive provided on the package. However, alternatively, the adhesive can also be provided on the additional element. The adhesive then sets and the additional component remains permanently secured to the package until the user deliberately removes the additional component from the package, for instance to consume the drink provided in the package.

Corresponding application devices and methods are known for example from DE 29 02 899 A1 or EP 1 042 172 B1. These differ in that, among other things, attaching the additional elements is carried out on packages, which are moved cyclically or continuously along the transport track. Compared to a cyclical application of the additional elements, the application speed can also be increased in practice by a continuous application of additional elements only to a limited extent, since the additional elements are to be held permanently on the package and the application of additional elements should take place reliably, i.e. as far as possible without operational disruptions. In addition, the constructive complexity for the application device and thus the equipment costs should not become too high.

The object of the present invention is therefore to design and refine the application device and the method of the type referred to at the outset and previously described in detail in such a way that the application of the additional elements can be carried out at a higher application speed without having to take on considerable losses with regard to the reliability of the application of the additional elements or the complexity of the equipment.

SUMMARY OF THE INVENTION

This object is achieved with an application device in that at least one positioning belt extending at least in sections along a transport track of packages is provided such that the additional elements applied to the packages are held on the packages, in particular pressed onto the packages, along at least one part of the transport track by the at least one positioning belt.

The above-mentioned object is also achieved by a method for applying additional elements, in particular straws, to packages, preferably cardboard composite packages, in particular using an application device as set forth above, in which the additional elements applied to the packages are held on the packages, in particular pressed onto the packages, along at least one part of the transport track by the at least one positioning belt.

The invention has recognised that the application speed can be increased in that a positioning belt is used which is moved at least in sections along the transport track and thus holds the additional elements to be applied to the packages by the applicator while the packages are moved further along the transport track. Preferably, the packages move continuously, in particular at an at least substantially uniform speed. Alternatively or additionally, it is also preferred if the positioning belt is moved at least along the corresponding section of the transport track also continuously, in particular at an at least substantially uniform speed.

Holding the additional elements is preferably accompanied by a pressing of the additional elements onto the packages to ensure that the additional elements are reliably fixed to the packages. The additional elements are during this preferably held on the packages until an adhesive for bonding the additional elements to the packages has set so that for the further handling of the packages sufficiently reliable connections between the additional elements and the packages are established. The adhesive can be applied on the additional elements and/or the packages before the application. Whether this is carried out immediately before the application, or whether the packages and/or the additional elements are already provided with adhesive supplied to the application device, can essentially be selected as desired.

It has surprisingly been found that the at least one positioning belt can actually contribute to a fixed fixing of the additional elements to the packages and does not lead to a shearing or undesired displacement of the additional elements on the packages, for example due to a minimal speed difference between the positioning belt and the packages. It has further been shown that the additional elements can be positioned in a defined way between the packages and the at least one positioning belt.

The positioning belt can be guided from the point at which the additional elements are applied to the packages by the applicator along the transport track of the packages such that the positioning belt holds the additional elements on the packages, or only come a certain distance after the application of the additional elements to the packages by the applicator in contact with the additional elements or hold the additional elements on the package and/or press the additional elements onto the package. The positioning belt follows the transport track of the packages for a certain distance while the positioning belt holds the additional elements on the package. The distance is sufficient to reliably fix the additional elements to the packages.

The application device and the application method are in particular designed so that similar packages are provided in succession with similar additional elements. This is particularly simple and reliable but not essential. In principle, varying packages and/or varying additional elements can also be used.

In the present case, packages are understood to mean, in particular, filled packages or containers, wherein the filling is preferably foodstuffs, in particular flowable foodstuffs. Such foodstuffs may be drinks, for example. For foodstuffs, in particular drinks, additional elements such as straws have particular significance.

In principle, the packages can be made of different materials, such as plastic. However, the installation of additional elements to cardboard composite packages is particularly expedient and desired by customers. These involve packages made of a packaging material in the form of a laminate, which may have a cardboard layer and outer plastic layers, in particular thermoplastic layers, for example made of polyethylene (PE). The cardboard confers sufficient stability to the packages, so that the packages can be easily handled and for example stacked. The plastic layers protect the cardboard from moisture and the foodstuffs from the absorption of undesired substances from the package. In addition, further layers can be provided, such as an aluminium layer, which prevents a diffusion of oxygen and other gases through the packaging material. If necessary, however, other composite packages made of differently constructed packaging materials would also be suitable.

In the production of corresponding cardboard plastic composite packages, packages which are initially open on one side are typically formed from the packaging material and then filled and sealed. The finished packages can then be provided immediately afterwards or in a separate process decoupled from the filling with at least one additional element.

Regardless of the type of package, additional elements in particular relate to straws, which may be packaged separately for reasons of hygiene. For the sake of simplicity, plastic films are suitable for packaging. So-called blister packs are particularly preferred for this purpose. These are usually transparent packages that reveal the wrapped straw. The straws or other additional elements are then sealed between two plastic films, for example. Straws attached to the packages make it possible to easily consume drinks on the go and without the risk of spilling the drink.

However, instead of straws or wrapped straws, spouts or closures can also be arranged as additional elements on the packages. The packages can then be easily unscrewed, opened and/or poured, which makes it easier to consume the packaged foodstuff. However, additional components of the foodstuff can also be provided as additional components on the packages, which, for example, are mixed with the other foodstuff just before consumption. In particular, flavours, vitamins, lumpy portions or the like are referred to here. It is also conceivable that the packages are provided with customer information or advertisements in the form of additional elements. These can be slips of paper or small brochures. It is also possible to arrange giveaways or marketing products such as toys or similar as additional elements on the packages.

For ease of understanding and to avoid unnecessary repetitions, the application device and the method are described together in the following, without distinguishing in each case in detail between the application device and the method. It will be apparent to the person skilled in the art, given the context, which feature is preferred with respect to the application device and the method.

In a first particularly preferred application device, at least one transportation belt of the transport device is designed to be moved at least in sections along the transport track in at least substantially the same direction and/or at least substantially at the same speed as the package segments. In this way it is ensured that the additional elements are reliably held on the packages. It is also ensured that the additional elements do not inadvertently move on the packages or are even sheared off of the packages. Thus, as required it may be provided that the at least one positioning belt gradually approaches the movement direction of the packages, i.e. the transport track of the packages, and/or their speed in order to hold the additional elements conveniently on the packages. Slight deviations in the speeds and/or directions of movement can either be tolerated or even desired. It is possibly advantageous if the at least one positioning belt holds the additional elements at least substantially on the packages with the delivery or application of the additional elements to the packages in order to fix the additional elements immediately. However, it may also be expedient if the positioning belt holds the additional elements on the packages only after a certain period of time and/or distance after delivering or applying the additional elements to the packages, such as not to adversely affect the application of the additional elements from at least one applicator to the packages.

In principle, the at least one positioning belt can be designed in different ways. It is particularly simple and expedient if the positioning belt is designed as a belt, approximately similar to a conveyor belt. As required, the belt can be made of plastic and/or comprise a woven fabric. This achieves a high degree of flexibility but at the same time strength of the positioning belt. The at least one positioning belt may alternatively or additionally also be formed as a chain, for example a link chain. If required, the necessary flexibility is then achieved by the flexible connection of the chain links. The chain can be designed to be longer lasting and easier to clean.

So that the additional elements can be held in a defined way on the packages, the positioning belt may be associated with a guide device guiding the positioning belt, at least partially in the region of the positioning belt in which the positioning belt holds the additional elements on the packages, and/or at least partially in the region of the positioning belt in which the positioning belt approaches the transport track of the packages. The guide device aligns the positioning belt in a certain way with respect to the transport track or with respect to the packages and/or the additional elements. Thus, the direction of movement and the speed of the positioning belt can be adapted to the movement of the packages along the transport track. However, it is also possible to set an exact positioning of the positioning belt and additional elements and/or a specific contact pressure between the positioning belt and the additional elements. The guide device may have sliding surfaces for sliding and/or rollers for unrolling the at least one positioning belt on the guide device. In principle, it is particularly expedient and structurally simple when the guide device is on the side of the at least one positioning belt facing away from the packages in contact with at least one positioning belt.

In order to be able to apply the additional elements quickly and accurately to the packages, it is expedient if the at least one applicator is provided pivotable about a pivoting axis, in particular rotatable about an axis of rotation. Thus, for example, by a swinging or rotating movement of the applicator, a guiding of the additional elements matched to the speed of movement of the packages can be achieved. In order to increase the application speed in a structurally simple manner, a plurality of applicators may, as required, be distributed uniformly around the pivoting axis, in particular around the axis of rotation. In this case, the applicators may form a carousel or an applicator wheel which as required rotates at a constant speed about an axis of rotation and thus provides additional elements to the packages at regular time intervals.

Alternatively, although in particularly additionally, the at least one positioning belt may be provided circumferentially around a deflection rotatable about an axis of rotation. Thus, the speed of movement of the positioning belt can be simply adapted to the circumferential speed of the applicator and/or the speed of movement of the packages along the transport track. The positioning belt may then be designed as a continuous belt in particular revolving about deflections, in particular guide rollers. For the undisrupted application of the additional elements to the packages by the at least one applicator on the one hand, and the suitable and reliable holding of the additional elements on the packages on the other, it may be expedient if the axis of rotation of the deflection and the pivoting axis or the axis of rotation of the at least one applicator, in particular the axis of rotation of the applicator wheel or carousel, are considerably spaced apart from one another.

Instead of a rotating deflection, the at least one positioning belt can also be guided and deflected around a fixed deflection. To reduce friction, the deflection may have rollers on which the positioning belt rolls. However, rotating deflections are preferred as they are known from conveyor belts.

With regard to the process flow, it is particularly effective to space apart from one another the axis of rotation of the deflection and the pivoting axis or axis of rotation of the at least one applicator, in particular the axis of rotation of the applicator wheel, in a direction at least substantially perpendicular to the transport track of the packages at the point of application of the additional elements to the packages. Thus, it can be achieved that the additional elements and the at least one positioning belt, at the point of application of the additional elements to the packages, have at least substantially the same speeds, if required, circumferential speeds, however still first interact at the point of application of the additional elements to the packages or somewhat thereafter with the additional elements and/or the packages.

Alternatively or additionally, it has been proved advantageous if the distance between the axis of rotation of the deflection and the pivoting axis or axis of rotation of the at least one applicator, in particular the axis of rotation of the applicator wheel, is less than the width, preferably less than half of the width, in particular less than a third of the width of the packages transverse to the transport track of the packages. Too great a distance is not required and can thus also be counter-productive due to the assembly space. However, the distance should still be considerable, wherein a dimension of the packages can also be used as a reference variable here. Good results are achieved if the distance discussed is at least a twentieth of the width, preferably at least a tenth of the width, in particular a fifth of the width of the packages transverse to the transport track of the packages.

For quick and secure receiving by the at least one applicator and for quick delivery of the additional elements from the applicator to the packages, the at least one applicator may comprise an application finger adjustable, in particular pivotable in the direction of an additional element guide and/or a package. Generally speaking, the application finger can be adjustable outwards and back in relation to a pivoting movement or rotational movement of the associated applicator. In the inner position, the applicator finger can then at least partially receive the additional elements and guide the additional elements along an additional element guide, at least partially while the at least one applicator is adjusted between the receiving position for receiving the additional element, and the application position for applying the additional elements to the packages. For this purpose, it is particularly expedient if the application finger is spring-loaded and/or preloaded in the direction of the additional element guide and/or the package. For receiving the additional element, the application finger can then be adjusted inwards in relation to the movement path of the applicator, wherein the application finger then automatically adjusts outwards in relation to the movement path of the applicator and then in the direction of the packages for the application of the additional elements on the packages. The application finger may comprise a recess for at least partially receiving the additional elements.

The at least one applicator may also comprise, adjacent to the application finger, at least one guide finger for the guiding of the additional element, which is in particular at least partially received in the application finger or held by the application finger, in an interlocking manner in the transport direction of the additional element. The guide finger may alternatively or additionally be used for removing the additional elements from a delivery unit, wherein the guide finger can at least partially engage behind the additional elements when picking up the additional elements, thereby applying the additional elements along a guide to the applicator and/or the application finger of the applicator. Alternatively or additionally, the application finger of the at least one applicator and the additional element guide are designed such that the additional element is at least in sections, in particular before the application of the additional elements to the packages, in contact with both the application finger and the additional element guide. The additional element guide thus facilitates the defined guiding of the additional elements to the point of application of the additional elements and thus to the packages themselves at the point of application.

It is particularly expedient for the defined application of the additional elements to the packages if the additional element guide is at the rear end in the transport direction at least substantially in contact with a package, in particular at least substantially adjacent to the surface section to be provided with the additional element. Then, shortly before the application, both the packages as well as the additional elements are guided by the additional element guide, in particular due to the additional elements and the packages coming into contact with the additional element guide. The corresponding guide ensures that the additional elements and the packages are precisely oriented to one another before the application.

A transportation belt comprising recesses may be provided for transporting the packages along the transport track of the packages in a defined manner. The recesses may be formed by at least one cam associated with each package and coming into contact with the package. In the case that there is one cam per package, the cam is provided in front of the associated package in the transport direction in order to drive the package in an interlocking manner. However, another cam can still be provided respectively in the transport direction behind the package, not only to drive the package in a defined manner, but also to hold it in position. In order to simplify the application of the additional elements to the packages or to carry this out more reliably, it may be expedient to provide the transportation belt on the side of the packages facing away from the at least one positioning belt. The transportation belt can thus form a kind of abutment for the application of the additional elements by the applicator.

In order to hold the additional elements more reliably and/or to be able to press them onto the packages, at least one positioning belt can be provided respectively on opposite sides of the applicator, in particular above and below the applicator. Thus, the additional elements can be held in a central section of the applicator or applied to the packages. The applied additional elements are then held on the packages and/or pressed onto the packages in both outer regions by separate positioning belts along at least part of the transport track.

In particular in the case that the additional elements are to be applied on surfaces of the packages which not oriented parallel to the transport track of the packages at the point of application of the additional elements to the packages, it may be appropriate for holding and/or pressing of the additional elements to the packages if the at least one positioning belt comprises holding cams for holding the additional elements on the packages, in particular for pressing the additional elements onto the packages. The holding cams are thus preferably provided so as to project laterally away from a belt section extending at least substantially in the transport direction of the at least one positioning belt. It may be particularly simple and effective if the holding cams extend at least substantially perpendicular to the belt section. The holding cams then preferably extend at least in sections in the direction of the transport track of the packages.

In addition, it may be preferable if after the application of the additional elements to the packages, respectively a receiving space is formed for the additional elements in which the additional elements can be held on the packages. The receiving spaces can be respectively formed at least in sections along the transport track of the packages simply and effectively by at least one belt section of the at least one positioning belt extending at least substantially in the transport direction of the at least one positioning belt, at least one holding cam of the at least one positioning belt and a package. Thus, it may be particularly advantageous if the at least one belt section and the at least one holding cam respectively are in contact in sections along the transport track of the packages on different side surfaces of the packages and/or are associated with them. The additional elements from different sides can then be held on the packages or on the surface sections provided for the application of the additional elements.

The advantages with regard to the holding of the additional elements on the packages and/or the pressing of the additional elements onto the packages are particularly effective if the packages comprise at least one surface section which is oriented so as to be inclined at least in sections along the transport track towards the transport direction of the packages and/or inclined towards at least one transport direction of the at least one positioning belt. The quick application of the additional elements on such surface sections without the at least one positioning belt is particularly difficult. In this case, the application device is provided for attaching the at least one additional element to the at least one inclined surface section. In a simple but suitable way, this can be provided in that the holding cams of the positioning belt are designed and arranged for holding the additional elements on the at least one inclined surface section.

In the above-mentioned connection, it is of particular importance if the at least one inclined surface section is inclined at least in sections along the transport track of the packages between 25° and 65°, preferably between 35° and 55°, in particular between 40° and 50°, in relation to the transport track and/or the at least one transport direction of the at least one positioning belt. With such surface sections, the advantages of the application device and the method for applying the additional elements are particularly significant.

Alternatively or additionally, the at least one inclined surface section may be provided in the edge region of the packages. The edge region may then provide the corresponding space for receiving the additional elements which are applied to the corresponding surface sections. Thus, for receiving the additional elements it is particularly preferred if the at least one inclined surface section is inclined between 25° and 65°, preferably between 35° and 55°, in particular between 40° and 50°, in relation to at least one adjacent side surface of the package.

In connection with a positioning belt comprising holding cams and/or inclined surface sections of the packages for applying additional elements, it is advisable if the at least one positioning belt, in particular the belt section extending in the transport direction of the at least one positioning belt, and the transport track of the packages approach one another in sections along the transport directions, in particular continuously. Otherwise, the at least one positioning belt, in particular the at least one holding cam, may impair the application of the additional elements by the at least one applicator to the inclined surface section of the package. However, if after the actual application of the additional element by the at least one applicator, the at least one positioning belt slowly approaches the packages, the additional elements can be securely held on and in the end secured to the packages. Thus, it is also particularly preferred if the approaching of the at least one positioning belt and the transport track of the packages is provided subsequently to the point of application of the additional elements to the package substrate. The guide device which has already been described can be used for the corresponding approaching of positioning belt and packages.

A comb device may be expedient in particular in the case of a positioning belt approaching the transport track of the packages in the region of application of the additional elements on the packages and slowly approaching the transport track in the region immediately adjacent in the transport direction. The comb device can be provided such that at least additional elements applied to the packages not properly positioned, are brought into contact with a guide surface of the comb device. As required, it can also be provided that only or also the additional elements applied to the packages properly positioned by the applicators are brought into contact with a guide surface of the comb device. The guide surface of the comb device may then, as a result of the interlocking between the additional element which is not properly positioned, i.e. not applied at the correct point, as required, and the guide surface, orient the additional element in relation to the associated package as predetermined. For example, an additional element applied somewhat offset or applied as provided can as required be moved, in particular pushed by the comb device into the receiving space for the additional element. Particularly preferably, the comb device is spaced apart from the additional element guide in the transport direction of the packages. In the gap remaining therebetween, the applicator can then apply the additional element to the package. Alternatively or additionally, the comb device is provided on the same side of the transport track or the packages as the positioning belt and/or the additional element guide. Furthermore, it is particularly expedient if the positioning belt finally approaches the packages after the comb device in order to then hold the additional elements as required without supporting the comb device on the packages.

Method-wise, it is particularly preferred if the at least one positioning belt is moved at least in sections along the transport track in at least substantially the same direction and/or at least substantially at the same speed as the package segments. Meanwhile, the at least one positioning belt positioned in a suitable manner relative to the additional elements can hold the additional elements on the packages or press them onto the packages.

Method-wise, it is also advantageous to provide high application speeds if the at least one applicator is pivoted about a pivoting axis, in particular rotated about an axis of rotation. The applicator, in particular a plurality of such applicators, can then apply additional elements to packages in quick succession. So that the additional elements can be transported reliably and in the predetermined manner to the packages and thus ultimately can be applied to the packages in the desired manner, it is preferred if the additional element to be applied is held on an additional element guide by at least one applicator, at least in sections during a pivoting movement or rotational movement of the applicator, and/or guided along the additional element guide.

When a belt section of the at least one positioning belt extending at least substantially in the transport direction of the at least one positioning belt, at least one holding cam of the at least one positioning belt and a package, preferably a surface section of the package inclined in relation to the transport track of the packages at least in sections along the transport track of the packages respectively form at least one receiving space for an additional element, an additional element can also be reliably provided on the edge regions or otherwise obliquely oriented surface sections of the package.

BRIEF DESCRIPTION OF THE DRAWINGS

The invention is explained in greater detail below by means of a drawing merely depicting exemplary embodiments, wherein.

DESCRIPTION OF THE INVENTION

Figure 1:
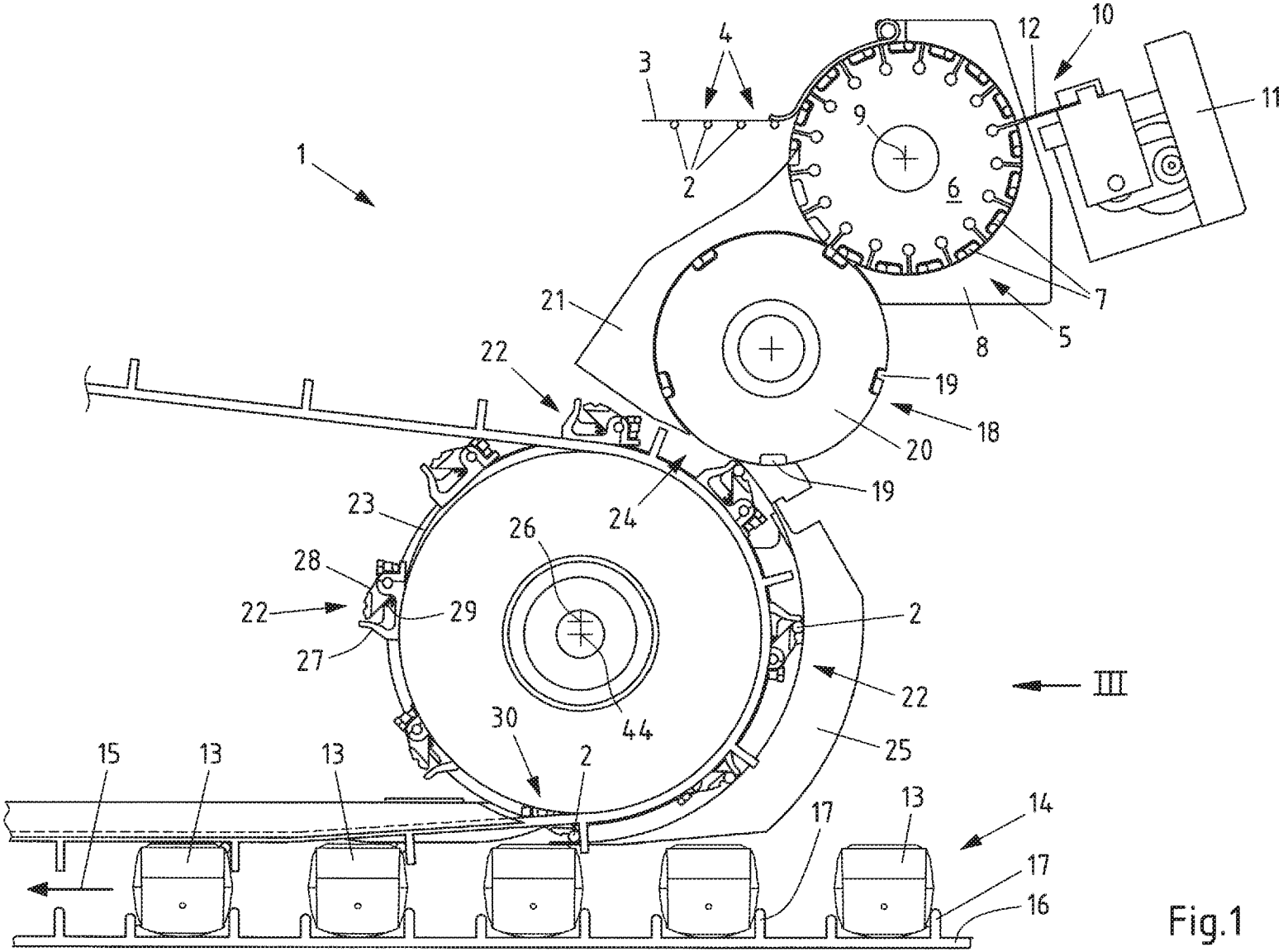
FIG. 1 shows a first application device according to the invention in a schematic top view.

In FIG. 1, an application device 1 for applying additional elements 2 in the form of straws is depicted. The application device 1 is supplied with a belt 3 made of two sealed-together, in particular transparent, plastic films, between which straws are provided at regular intervals. Accordingly, the belt 3 is formed by an interconnected series of blister packs 4 and drawn in by a supply device 5 which comprises a supply carousel 6 having recesses 7 distributed over the circumference and a belt guide 8 arranged at least partially around the supply carousel 6. The supply carousel 6 rotates about a central axis of rotation 9 in a stepwise manner in a clockwise direction. With each rotation step, another straw is received in a recess 7 of the supply carousel 6. The belt 3 of plastic films and straws remains held between the supply carousel 6 and the belt guide 8. After each rotation step of the supply carousel 6, the belt 3 of plastic films and straws is separated in a cutting position 10 by a separating device 11 by means of a cutting blade 12. In this way, the straws are separated in a stepwise manner.

Each straw, together with the plastic films, between which the straws are respectively sealed, forms an additional element 2 which is provided for application on a package 13. The corresponding packages 13 are transported at another point of the application device 1 by a transport device 14 successively along a transport track 15 along or through the application device 1. For this purpose, the transport device 14 comprises a transportation belt 16 with a series of cams 17 which extend in the direction of the transport track 15 of the packages 13. The transportation belt 15 extends laterally to the packages 13 and laterally to the transport track 15 of the packages 13. It is not shown in detail that the transportation belt 16 is formed as a continuous belt and continuously revolves around guide rollers.

After further rotation steps, the separated additional elements 2 are relayed to a delivery device 18 from the supply carousel 6 of the supply device 5. The individual additional elements 2 each pass into a recess 19 of a delivery wheel 20, which turns in a swelling manner, i.e. with repeatedly varying speed, in an anti-clockwise direction and cooperates in sections with a radially adjacent delivery guide 21 to hold the additional elements 2 in the recesses 19 and thus to accelerate to the circumferential speed of applicators 22 of an applicator wheel 23, from which the additional elements 2 are picked up at a pick-up position 24. Thus, the applicators 22 engage in the delivery wheel 20 and thus create an interlocking with the additional elements 2. As a result of the interlocking between the applicators 22 and the additional elements 2, the additional elements 2 are removed from the delivery wheel 20 and then moved between the corresponding applicator 22 and an additional element guide 25 in the direction of the packages 13.

Figure 2:
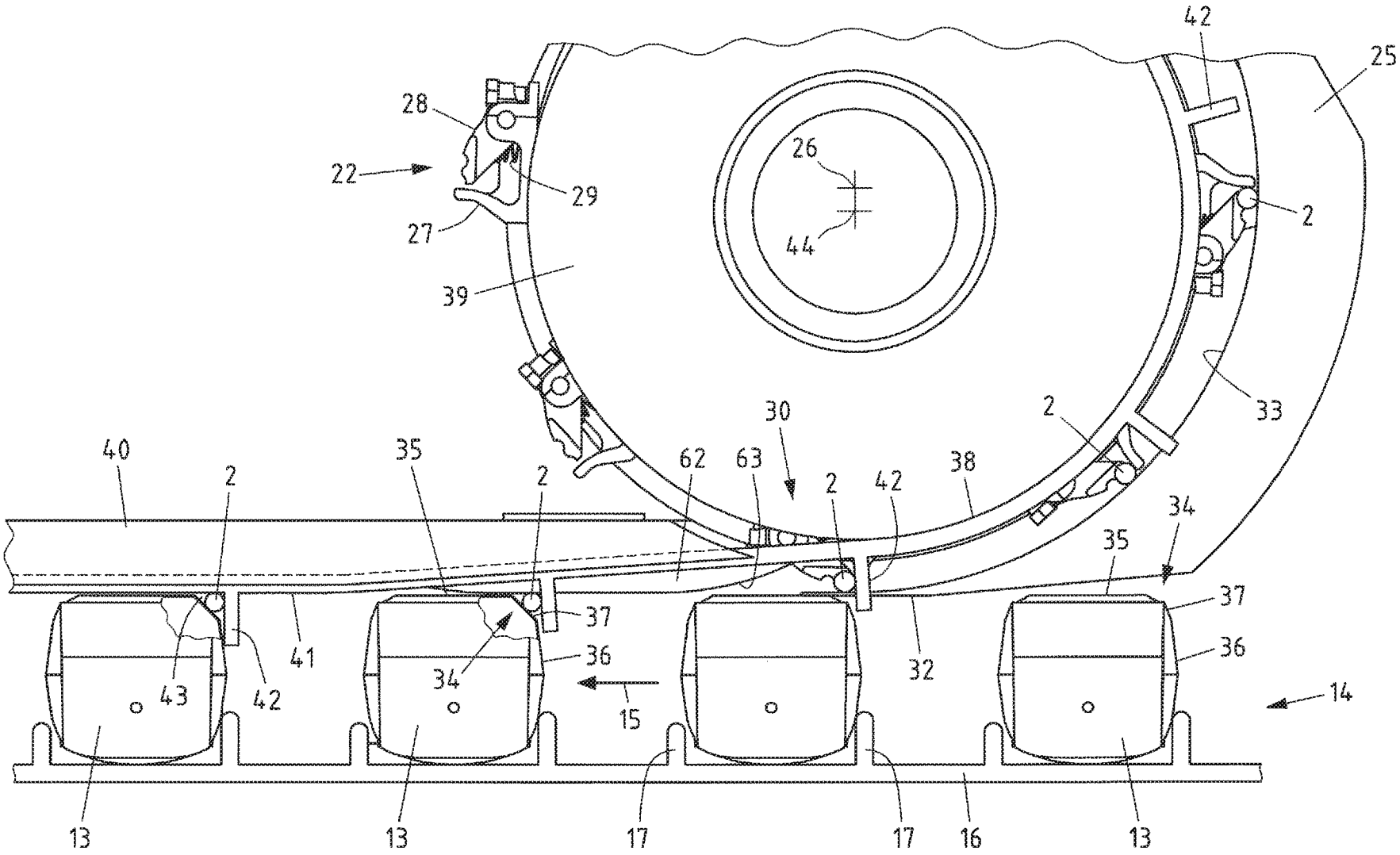
FIG. 2 shows a detail of the application device from FIG. 1 in a schematic top view.

In FIG. 2 it is shown in detail how the additional elements 2 are transported between the applicators 22 and the additional element guide 25 along an arc-shaped section to the packages 13. The applicator wheel 23 preferably rotates continuously in a clockwise direction about an axis of rotation 26. Subsequently, the applicators 22 are moved continuously and circularly about the axis of rotation 26 of the applicator wheel 23. The applicators 22 comprise a guide finger 27 which engages in the delivery wheel 20 and behind the additional elements 2 in an interlocking manner. The guide finger 27 is arranged fixed on the depicted and insofar preferred applicators 22. The guide finger 27 presses the additional elements 2 out of the delivery wheel 20 and against the additional element guide 25. The additional elements 2 are thus partially held by an application finger 28, in particular at least partially received in a recess of an application finger 28. The application finger 28 is provided pivotably on the applicator 22 and can be pivoted radially inwards against the restoring force of a spring means 29. This is achieved with the pick-up of the additional elements 2 from the delivery wheel 20 in the pick-up position 24. As a result of the restoring force, the application finger 28 presses the additional elements 2 radially outwards against the additional element guide 25. The additional elements 2 can in this case not slip off the applicators 22 because the additional elements 2 are held in an interlocking manner by the guide fingers 27 of the applicators 22.

The additional element guide 25 ends on or just before the application position 30 of the applicators 22, at which the applicators 22 deliver or apply the additional elements 2 to the packages 13. The packages 13 can already be provided with adhesive for this purpose. If the additional elements 2 are no longer guided by the additional element guide 25, the application finger 28 pivots radially outwards about its pivoting axis 31 and presses the additional element 2 onto the package 13 guided past the application position 30, and preferably against the adhesive provided on the package 13. The packages 13 are guided past the application position 30 of the applicators 22 at a speed which at least substantially corresponds to the circumferential speed of the applicators 22, in particular the transport speed of the additional elements 2. Before the application of the additional elements 2, the packages 13 are also in contact with the additional element guide 25, but on another guide surface 32 than the additional elements 2, specifically an outer guide surface 32 and not on the inner guide surface 33 coming into contact with the additional elements 2. In the depicted and insofar preferred application device 1, this is provided such that the packages 13 only come into contact with the corresponding guide surface 32 of the additional element guide 25 along the transport track 15 of the packages 13 just before the application of the additional elements 2. Thus, the additional elements 2 and the packages 13 are oriented to one another.

The packages 13 to be provided with additional elements 2 comprise bevelled edge regions 34 which comprise surface sections 37 both inclined towards the adjacent side surfaces 35, 36 and also towards the transport track 15 of the packages 13. The additional elements 2 are to be attached on one of these surface sections 37, namely on the surface sections 37 associated with the applicators 22 and at the rear in the transport direction of the packages 13. The application finger 28 presses the additional elements 2 in the application position 30 onto these surface sections 37. Subsequently, the additional elements 2 are held in the corresponding position by positioning belts 38 until an adhesive bond is established between the package 13 and the additional element 2.

In FIG. 2, the positioning belts 38 are arranged overlapping one another so that only one of the positioning belts 38 is depicted. The positioning belts 38 are designed as a continuous belt which continuously revolves about deflections 39. Thus, the positioning belts 38 in the depicted and insofar preferred application device 1 gradually approach the transport track 15 of the packages 13 and therefore the packages 13 themselves via a guide device 40. The positioning belts 38 thus slide on the guide device 40 until a belt section 41 of the positioning belts 38 rests at least substantially on the packages 13.

The positioning belts 38 also respectively comprise holding cams 42 protruding from a belt sections 41 in the direction of the packages 13 or in the direction of the transport track 15 of the packages 13. The holding cams 42 are approached from the side and from the rear in the transport direction of the packages 13 to the rear side of the packages 13 seen in the transport direction of the packages 13. The belt section 41, respectively one holding cam 42 and one package 13 thus form a receiving space 43 in the edge region 34 of the respective package 13 for receiving the additional elements 2. The additional elements 2 are in this way held on the packages 13 and pressed onto the packages 13. This takes place over a determined distance along the transport track 15 of the packages 13. Subsequently, the positioning belts 38 are retracted from the packages 13 again. The positioning belts 38 are then guided back to be able to position and hold further additional elements 2 on further packages 13.

To ensure that the additional elements 2 arrive in the receiving spaces 43 between the packages 13 and the positioning belts 38 after the application by the applicators 22 onto the packages 13, in the depicted and insofar preferred application device 1, a comb device 62 is provided. The comb device 62 is spaced apart from the additional element guide 25 so that the applicators 22 can deliver or apply the additional elements 2 to the packages 13 in the intermediate space between the additional element guide 25 and the comb device 62. In any case, additional elements 2 applied by the applicators 22 not in their final position but displaced to the side surface 35 of the packages 13 facing the positioning belt 38 come in the transport direction of the packages 13 into contact with a guide surface 63 of the comb device 62. The additional element 2 is thus pressed against the guide surface 63 or guided by the guide surface 63 into the receiving space 43 between the package 13 and the positioning belts 38. Once there, the additional element 2 is then pressed on the further transport path of the package 13 by the positioning belts 38 at the designated point on the package 13, so that a permanent bonding between the additional element 2 and the package 13 can be achieved.

In the region of the application position 30 of the additional elements 2 to the packages 13, the positioning belts 38 are deflected about a deflection 39 which rotates about an axis of rotation 44. This axis of rotation 44 is spaced apart from the axis of rotation 26 of the applicator wheel 23 in the direction of the application position 30 of the additional elements 2 to the packages 13. However, the axes of rotation 26, 44 are aligned at least substantially in parallel to one another. Thereby and by the radius of the deflection 39 it is achieved that the holding cams 42 neither hinder the guiding of the additional elements 2 to the packages 13 along the additional element guide 25, nor the actual application of the additional elements 2 by the applicators 22 in the application position 30. Rather, the holding cams 42 are slowly guided to the additional elements 2 so that the holding cams 42 are only brought into contact with the additional elements 2 upon the application of the additional elements 2 to the packages 13.

Figure 3:
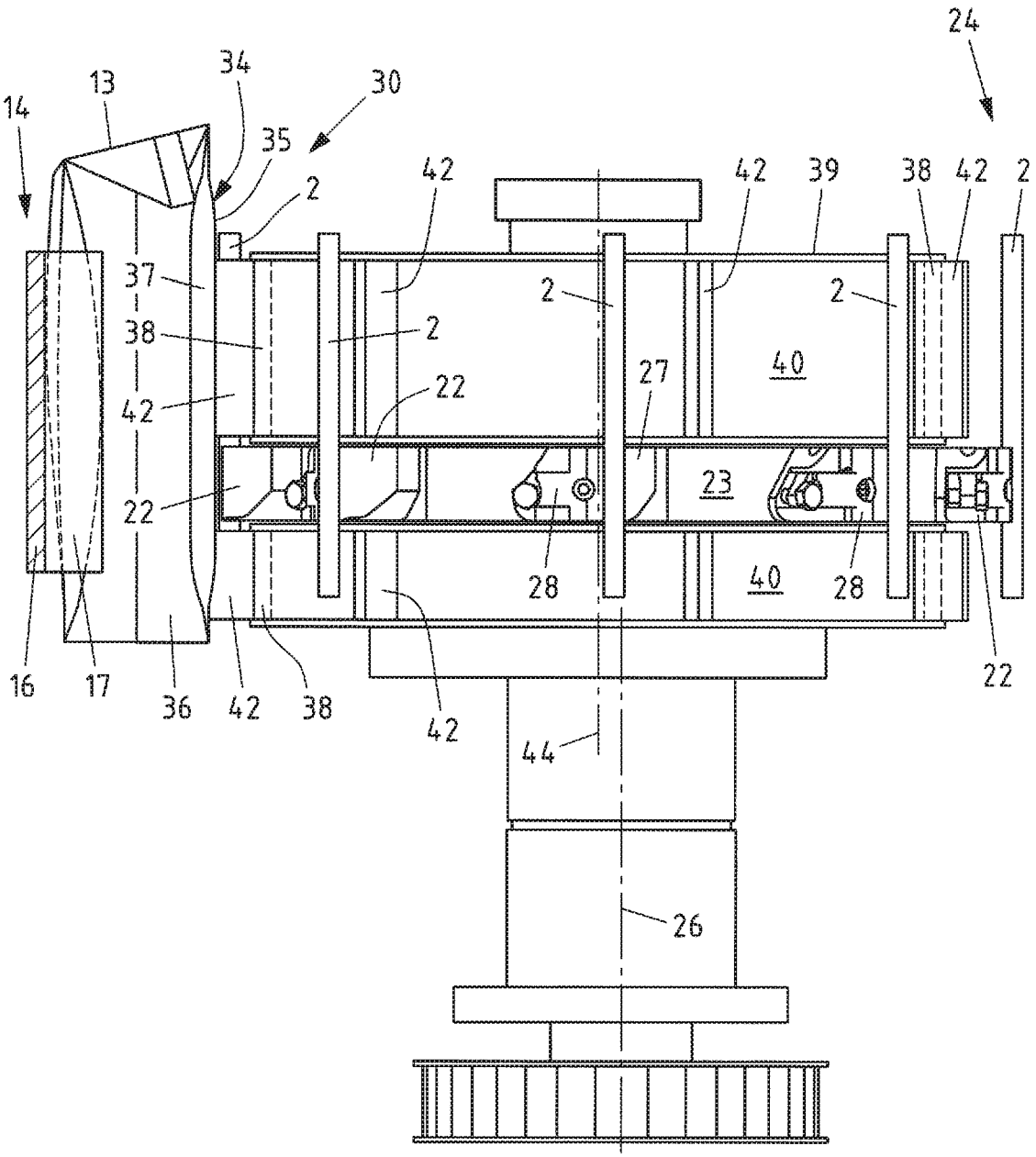
FIG. 3 shows a detail of the application device from FIG. 1 in a schematic side view.

In FIG. 3, a side view of the deflection 39 of the positioning belts 38, the applicator wheel 23, the transportation belt 16 for transporting the packages 13 and the transport track 15 of the packages 13 are depicted. The transportation belt 16 is provided on the side of the packages 13 facing away from the applicator wheel 23 and with its cams 17 forms an interlocking with the packages 13, which comprise bevelled edge regions 34. An additional element 2 is respectively attached at the edge region 34, which is the rear in the direction of view and is associated with the applicator wheel 23. The additional elements 2 are guided from the applicators 22, which are arranged on an applicator wheel 23 which continuously rotates about an axis of rotation 26. The additional elements 2 are respectively held between the guide finger 27 and the application finger 28 of the applicators 22. For better clarity, the associated additional element guide 25 and the delivery wheel 20 are not shown. In the depicted and insofar preferred application device 1, respectively a positioning belt 38 is deflected above and below the applicators 22 by a deflection 39. The deflection 39 rotates about an axis of rotation 44 which is offset in relation to the axis of rotation 26 of the applicator wheel 23 to the transport track 15 of the packages 13 or to the application position 30 of the applicators 22. Therefore, the holding cams 42 of the positioning belts 38 approach along the circumference of the deflection 39 the additional elements 2. The applicator wheel 23 and the deflection 39 are driven together in the depicted and insofar preferred application device 1. In addition, the applicator wheel 23 and the deflection 39 have at least substantially the same diameter.

Figure 4A:
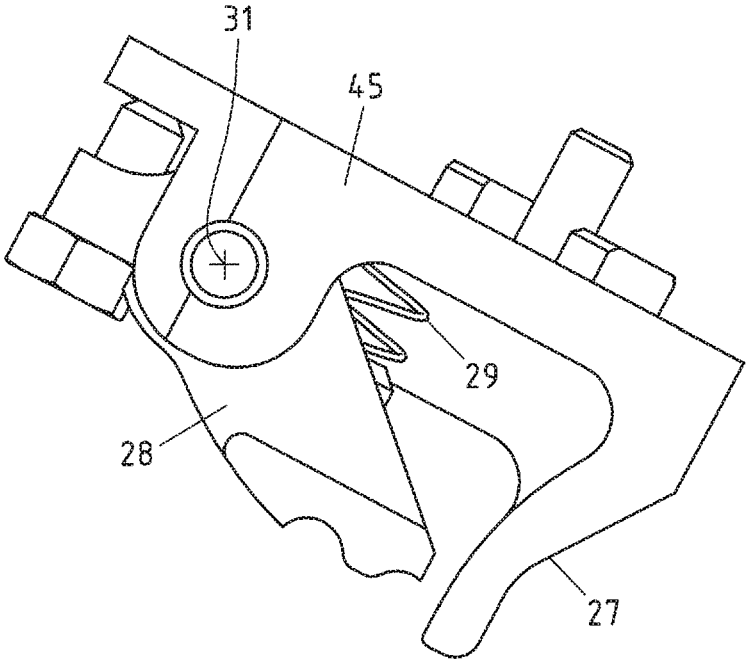
FIGS. 4A-B show an applicator of the application device from FIG. 1 in a top view and in a perspective view.
Figure 4B:
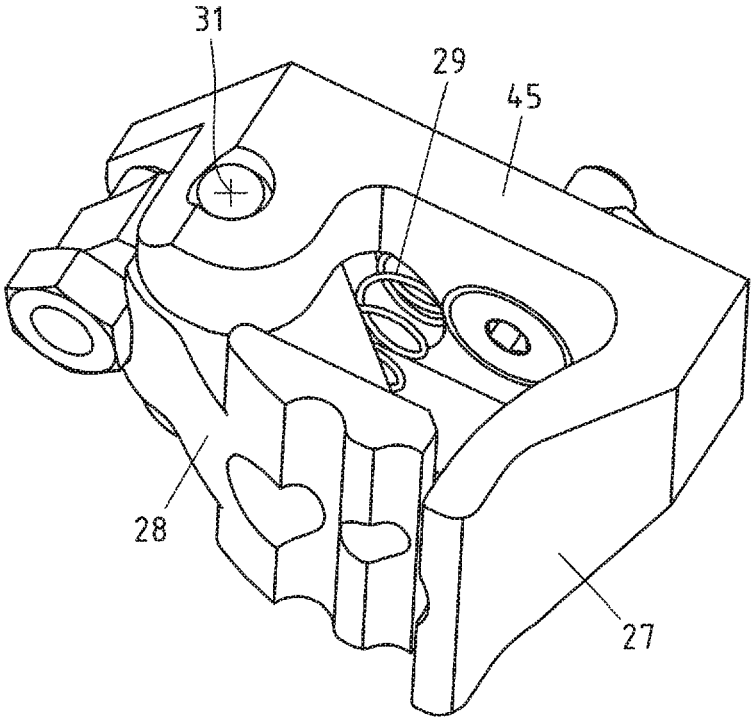

An applicator 22 is shown from different perspectives in FIGS. 4A-B. The applicators 22 comprise a base 45 with which the applicators 22 are secured to the applicator wheel 23. The guide finger 27 extends outwards in relation to the base 45. The application finger 28 is provided adjacent to the guide finger 27, which application finger is pivotably secured on the base 45 of the applicator 22 about a pivoting axis 31. In addition, a spring means 29 is provided between the base 45 and the application finger 28, which spring means provides the pivoting of the application finger 28 to an outer position as long as the application finger 28 is not blocked by an interlocking. This is the case if the applicator 22 holds an additional element 2 and the application finger 28 presses the additional element 2 outwards against the additional element guide 25.

Figure 5:
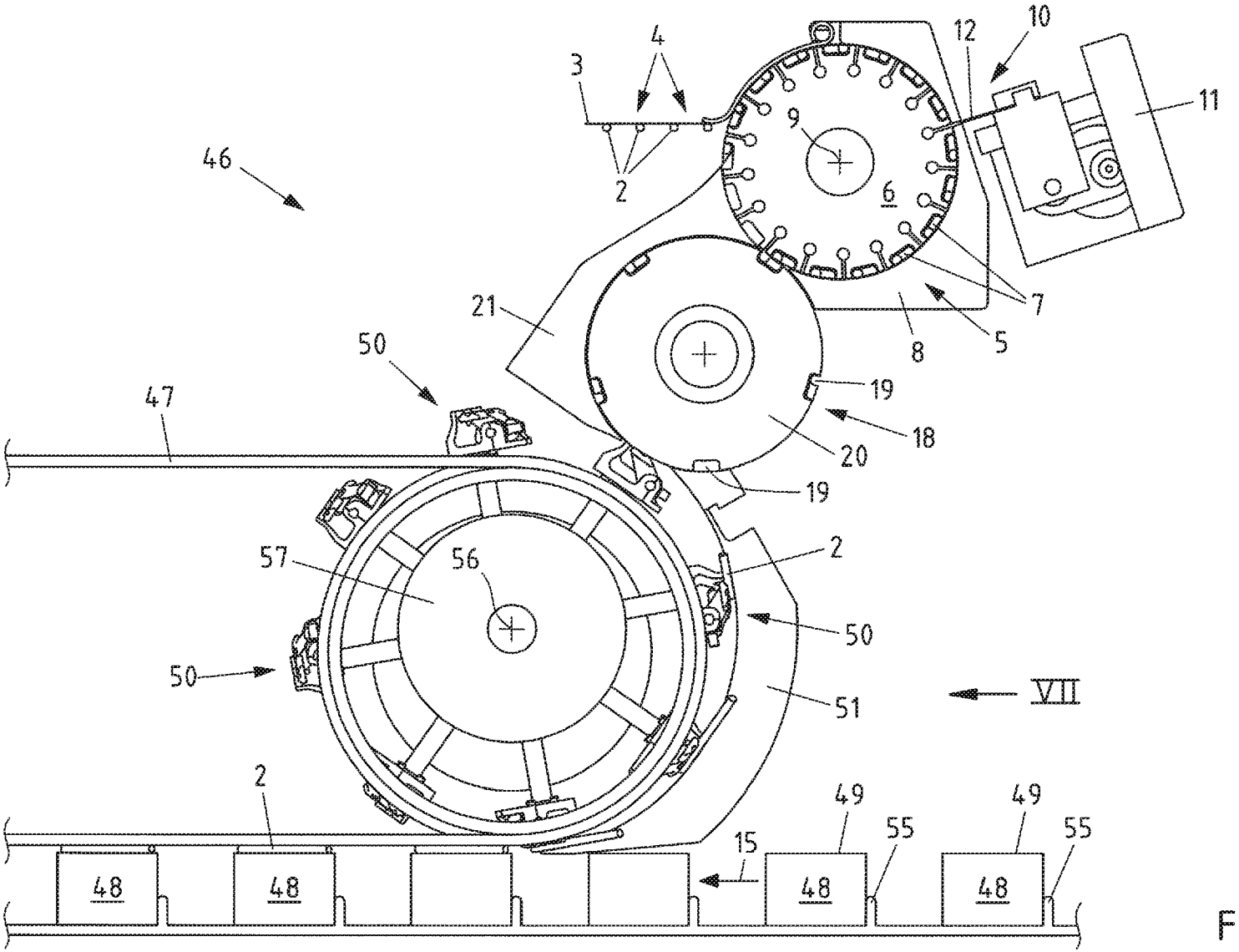
FIG. 5 shows a second application device according to the invention in a schematic top view.

An alternative application device 46 is shown in FIG. 5. This corresponds in many parts to the application device 1 according to FIG. 1. Therefore, the same reference signs are used for the same components and only certain components are described again. A substantial difference from the application device 1 of FIG. 1 is that only one positioning belt 47 is provided and that this positioning belt 47 does not require a holding cam 42. This is due to the fact that, with the depicted and insofar preferred application device 46, additional elements 2 are applied to cuboid packages 48, specifically on a side surface 49 of the packages 48, which are oriented at least substantially parallel to the transport track 15 of the packages 48 in the application position 30 of the applicators 50.

Figure 6:
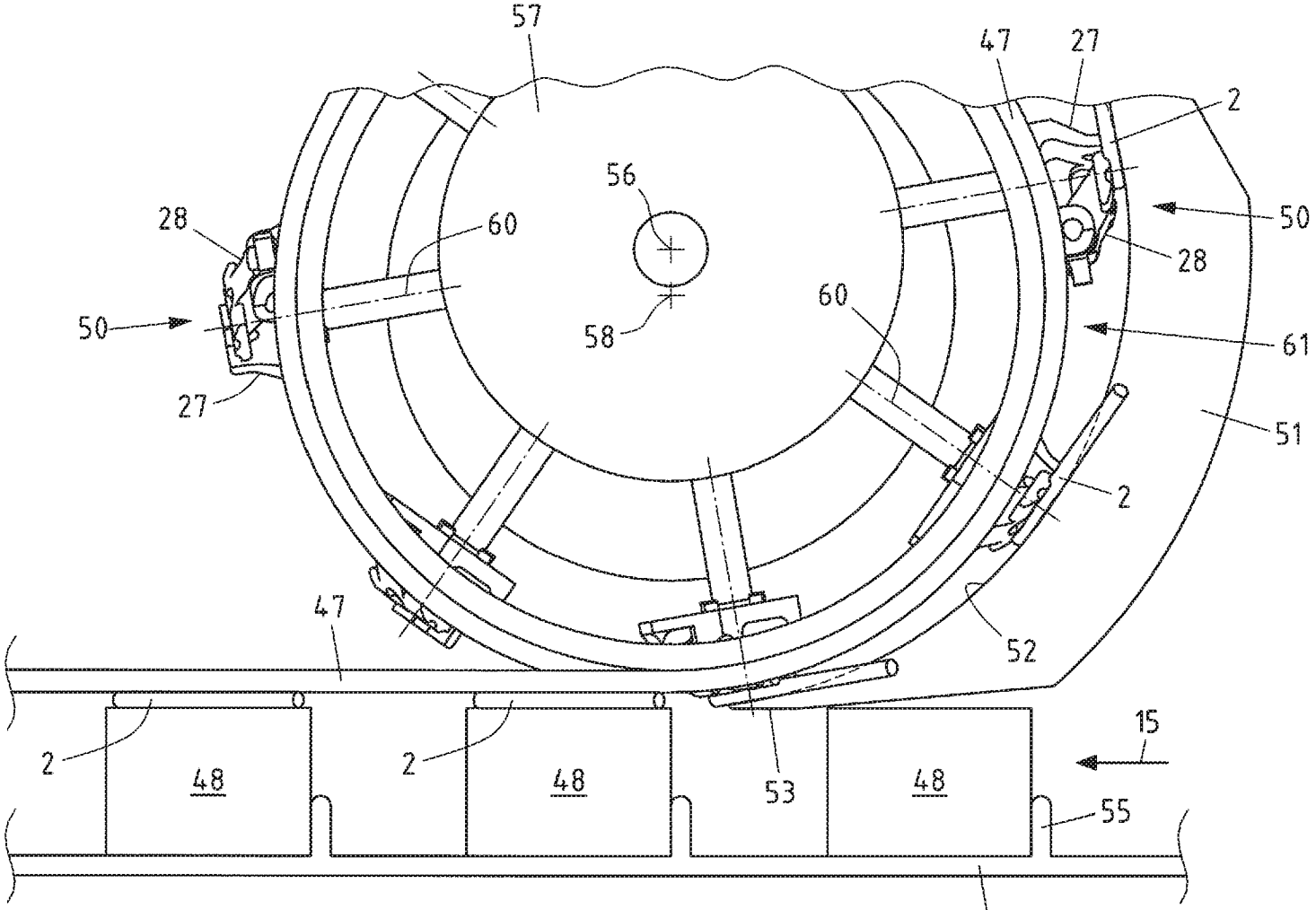
FIG. 6 shows a detail of the application device from FIG. 5 in a schematic top view.

The application of the additional elements 2 is shown in detail in FIG. 6. The additional elements 2 are held by the applicators 50 and guided along an additional element guide 51 on an arc-shaped track to the application position 30 or the packages 48. At the end of the additional element guide 51, the additional elements 2 are guided from the additional element guide 51 at an inner guide surface 52 and the packages 48 are guided at an outer guide surface 53, on which the packages 48 slide along and thus are oriented correspondingly to the additional elements 2. The additional elements 2 then directly arrive from the additional element guide 51 in the application position 30 of the applicators 50 at the packages 48. In the process the applicators 50 press the additional elements 2 by means of the spring-loaded application fingers 28 onto the packages 48, which are provided with an adhesive at corresponding points. With this delivery of the additional elements 2, the positioning belt 47 is brought into contact with the additional elements 2 and is moved at the same speed and in the same direction as the packages 48. The packages 48 are transported by a transportation belt 54 along a transport track 15, in which each package 48 is in interlocking engagement with the cams 55. However, two cams 55 per package 48 could also be provided, as is the case with the application device 1 according to FIG. 1. A slow approaching of the positioning belt 47 after the application of the additional elements 2 by the applicators 50 to the package 48 here is as unnecessary as is the use of a guide device for the positioning belt 47.

Similar to the application device 1 according to FIG. 1, the applicators 50 are combined to form an applicator wheel 57 rotating about an axis of rotation 56. In contrast to the applicator wheel 23 of FIG. 1, the applicators 50 are rotated about a further axis of rotation 58 when rotating about the axis of rotation 56. This is achieved by a cam disc by means of a corresponding coupling of the applicators 50 to the cam disc. A roller rolls on the cam disc, which is moved upwards and downwards again corresponding to the inclinations of the cam disc. Via a coupling lever, this movement is converted into a rotary movement of the applicators 50 and a bearing of the applicators 50. The coupling and the cam disc are not shown for the sake of clarity. As a result of the rotation of the applicators 50, the additional elements can be picked up by the applicators 50 in an orientation parallel to the axis of rotation 56 of the applicator wheel 57 and applied to the packages 48 in an orientation inclined relative to the axis of rotation 56. The additional elements 2 can thus be applied diagonally to the corresponding side surface 49 of the package 48. Thus, straws can be applied which are longer than the height of the package 48 without problems.

The positioning belt 47 revolves about a deflection 59, which also rotates about an axis of rotation 58, wherein this axis of rotation 58 is offset in relation to the axis of rotation 56 of the applicator wheel 57 in the direction of the packages 48 or the application position 30 of the applicators 50. In this way and due to the radius of the deflection 59, between the additional element guide 51 and the positioning belt 47, a gap 61 tapering in the direction of the application position 30 of the applicators 50 is provided which corresponds at least substantially to the width of the additional elements 2 in the application position 30 of the applicators 50. Thus, the additional elements 2 come at least substantially at the point of application of the additional elements 2 by the applicators 50 into contact with the positioning belt 47, which then holds the additional elements 2 on the package 48 or presses them against the package 48. However, the positioning belt 47 does not also press the additional elements 2 against the additional element guide 51, which may lead to increased friction and thus to damage to the additional elements 2, in particular the plastic film. At the same time, the additional element 2 is held on the package 48 during the application to the package 48 and not only at a considerable distance of the package 48 later.

Figure 7:
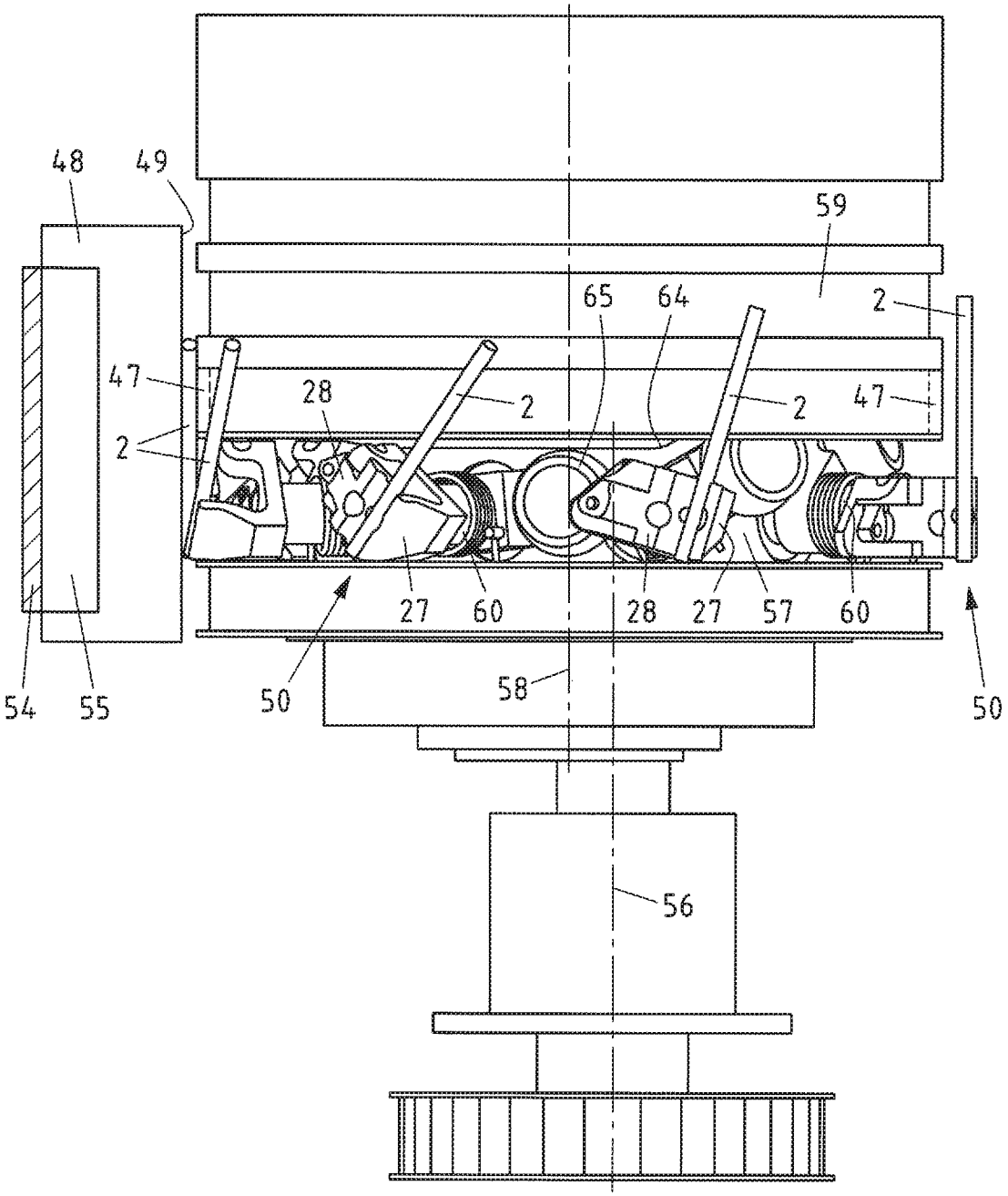
FIG. 7 shows a detail of the application device from FIG. 5 in a schematic side view.

In FIG. 7, the transportation belt 54, the packages 48, the applicator wheel 57 and the deflection 59 are shown in detail. The packages 48 are transported past the applicator wheel 57 by the transportation belt 54 with a side surface 49 parallel to the transport direction. The applicators 50 rotate about a common axis of rotation 56 and thus pivot about a pivoting axis 60 perpendicular to this axis of rotation 56. Thus, the applicators 50 pick up the additional elements 2 in an orientation parallel to the axis of rotation 56 and then rotate about a longitudinal axis so that the additional elements 2 are applied in the application position 30 diagonally to the adjacent side surface 49 on the packages 48. In the depicted and insofar preferred application device 46, the positioning belt 47 is deflected above the applicators 50 by a deflection 59. The axis of rotation 58 of the deflection 59 is offset laterally in the direction of the packages 48 or the application position 30 of the applicators 50. The applicator wheel 57 and the deflection 59 may have at least substantially the same diameter. At the time of the delivery of the additional elements 2, the positioning belt 47 is at least substantially spaced apart from the packages 48 by the width of the additional elements 2. The distance of the positioning belt 47 from the packages 48 may, as required, be somewhat less than the width of the additional elements 2 so as to be able to press the additional elements 2 onto the corresponding side surfaces 49 of the packages 48.

For simultaneous rotation of the applicators 22 about the axis of rotation 56 and pivoting about the pivoting axis 60, the application device 46 is provided with a control cam 64. Rollers 65 run on the control cam 64 engaged via spring means, which rollers are adjusted up and down parallel to the axis of rotation 56. This adjustment of the rollers 65 is converted via a lever means into a pivoting of the applicators 22 about the pivoting axis 60. Cam discs having similar control cams 64 are generally known from the prior art.

LIST OF REFERENCE SIGNS

1 Application device
2 Additional element
3 Belt
4 Blister pack
5 Supply device
6 Supply carousel
7 Recess
8 Belt guide
9 Axis of rotation
10 Cutting position
11 Separating device
12 Cutting blade
13 Packages
14 Transport device
15 Transport track
16 Transportation belt
17 Cams
18 Delivery device
19 Recess
20 Delivery wheel
21 Delivery guide
22 Applicator
23 Applicator wheel
24 Pick-up position
25 Additional element guide
26 Axis of rotation
27 Guide finger
28 Application finger
29 Spring means
30 Application position
31 Pivoting axis
32 Guide surface
33 Guide surface
34 Edge region
35 Side surface
36 Side surface
37 Surface section
38 Positioning belt
39 Deflection
40 Guide device
41 Belt section
42 Holding cam
43 Receiving space
44 Axis of rotation
45 Base
46 Application device
47 Positioning belt
48 Package
49 Side surface
50 Applicator
51 Additional element guide
52 Guide surface
53 Guide surface
54 Transportation belt
55 Cams
56 Axis of rotation
57 Applicator wheel
58 Axis of rotation
59 Deflection

60 Pivoting axis
61 Gap
62 Comb device
63 Guide surface
64 Control cam
65 Rollers

The invention claimed is:

1. An application device for applying additional elements to packages having at least one transport device for transporting the packages along a transport track, having at least one applicator adjustable, from a pick-up position for picking up the additional elements, to an application position for applying the additional elements to the packages and back, wherein at least one positioning belt extending at least in sections along the transport track of the packages is provided such that the additional elements applied to the packages are held on the packages along at least a part of the transport track by the positioning belt and the at least one positioning belt revolves around a deflection rotatable about an axis of rotation of the at least one applicator, and in that, the axis of rotation of the deflection and the axis of rotation of the at least one applicator are spaced apart from one another in that the distance between the axis of rotation of the deflection and the axis of rotation of the applicator wheel, is less than the width, of the packages transverse to the transport track of the packages.

2. The application device according to claim 1, wherein at least one transportation belt of the transport device is designed to be moved at least in sections along the transport track in at least substantially the same direction and/or at least substantially at the same speed as the packages and/or in that the at least one positioning belt is designed as a belt and/or as a chain.

3. The application device according to claim 1, wherein in the region where the additional elements are held on the packages and/or in the region where the at least one positioning belt approaches the transport track of the packages, a guide device guiding the positioning belt in the transport direction is provided, and in that, the guide device is in contact with the positioning belt on the side of the positioning belt facing away from the packages.

4. The application device according to claim 1, wherein the at least one applicator is provided pivotably about a pivoting axis of rotation, and in that, a plurality of applicators designed as an applicator wheel, is uniformly distributed around the axis of rotation.

5. The application device according to claim 1, wherein the axis of rotation of the deflection and the pivoting axis or axis of rotation of the applicator wheel are spaced apart in a direction at least substantially perpendicular to the transport track of the packages at the point of application of the additional elements on the packages.

6. The application device according to claim 1, wherein the at least one applicator comprises an applicator finger adjustable and pivotable, in the direction of an additional element guide and/or a package, for at least partially receiving the additional element, for applying the additional element and/or for holding the additional element, and in that, the application finger is spring-loaded and/or preloaded in the direction of the additional element guide and/or the package.

7. The application device according to claim 6, wherein the at least one applicator comprises, at least adjacent to the application finger, a guide finger for guiding the additional element at least partially held and received by the application finger in an interlocking manner in the transport direction of the additional element, and/or in that the application finger of the applicator and the additional element guide are designed such that the additional element is in contact with both the application finger as well as the additional element guide at least in sections before the application of additional elements to the packages.

8. The application device according to claim 6, wherein the additional element guide is at the rear end in the transport direction at least substantially in contact with a package at least substantially adjacent to the surface section to be provided with the additional element.

9. The application device according to claim 1, wherein the at least one transport device comprising a transportation belt comprising a recess is provided for transporting the packages along the transport track, and in that the transportation belt is provided on the side of the packages facing away from the at least one positioning belt.

10. The application device according to claim 1, wherein the additional elements applied to the packages are held on the packages along at least a part of the transport track by the at least one positioning belt and a second positioning belt, the second positioning belt extending at least in sections along the transport track such that the additional elements applied to the packages are held on the packages along at least a part of the transport track by the positioning belt and the second positioning belt is provided respectively on opposite sides of the applicator.

11. The application device according to claim 1, wherein the at least one positioning belt comprises holding cams for holding the additional elements on the packages and in that, the holding cam extends from a belt section extending at least substantially in the transport direction of the positioning belt to the side and at least in sections in the direction of the transport track of the packages.

12. The application device according to claim 1, wherein a belt section of the positioning belt extending at least substantially in the transport direction of the at least one positioning belt, at least one holding cam of the positioning belt and a package respectively define at least one receiving space for an additional element at least in sections along the transport track of the packages, and in that, the belt section and the holding cam are in contact, respectively in sections along the transport track of the packages, on different side surfaces of the package.

13. The application device according to claim 1, wherein the packages comprise at least one surface section oriented at least in sections along the transport track inclined in the transport direction of the transport track and inclined in at least one transport direction of the at least one positioning belt, and in that the application device is provided for attaching the additional element on the inclined surface section, and in that the holding cams are provided for holding the additional elements on the inclined surface sections.

14. The application device according to claim 13, wherein the at least one inclined surface section is inclined at least in sections along the transport track of the packages by between 25° and 65 in relation to the transport track and/or the at least one transport direction of the at least one positioning belt.

15. The application device according to claim 13, wherein the at least one inclined surface section is provided in the edge region of the packages, and in that the inclined surface section is inclined between 25° and 65° in relation to at least one adjacent side surface of the package.

16. The application device according to claim 1, wherein the at least one positioning belt and the transport track of the packages approach one another in sections along the transport direction, the approaching of the positioning belt and the transport track of the packages is provided subsequently to the point of application of the additional elements to the packages.

17. A method for applying straws, to cardboard composite packages having an application device according to claim 1, in which the straws guided toward the packages are held on the packages, along at least one part of the transport track by the at least one positioning belt.

18. The method according to claim 17, in which the at least one positioning belt is moved at least in sections along the transport track in at least substantially the same direction and/or at least substantially at the same speed as the packages.

19. The method according to claim 17, in which the at least one applicator is pivoted about a pivoting axis, in particular rotated about an axis of rotation, and/or in which the additional element to be applied by the applicator is held on an additional element guide at least in sections during a pivoting movement or rotating movement of the applicator, and/or guided along the additional element guide.

20. The method according to claim 17, in which a belt section of the positioning belt extending at least substantially in the transport direction of the at least one positioning belt, at least one holding cam of the positioning belt and a surface section of the package inclined in relation to the transport track of the packages at least in sections along the transport track of the packages respectively form at least one receiving space for an additional element.

* * * * *